United States Patent [19]

Parker et al.

[11] 4,362,008

[45] Dec. 7, 1982

[54] METHOD AND APPARATUS FOR FORMING COMPOSITE YARN

[76] Inventors: Alan Parker, 7 Darvel Close, Breightmet, Bolton; Peter J. Dickinson, 30 Narcissus Ave., Helmshore, Rossendale, both of England

[21] Appl. No.: 218,313

[22] Filed: Dec. 19, 1980

[30] Foreign Application Priority Data

Dec. 22, 1979 [GB] United Kingdom ..... 7944318

[51] Int. Cl.[3] ..... D01H 1/12; D02G 3/38; D01H 1/135

[52] U.S. Cl. ..... 57/5; 57/6; 57/401

[58] Field of Search ..... 57/5, 224, 400, 401

[56] References Cited

U.S. PATENT DOCUMENTS 4,107,909 8/1978 Fehrer et al. ..... 57/5
4,130,983 12/1978 Dammann et al. ..... 57/401 X
4,222,222 9/1980 Didek et al. ..... 57/401
4,241,574 12/1980 Turk et al. ..... 57/401 X
4,249,368 2/1981 Fehrer ..... 57/401X
4,253,297 3/1981 Pacholski et al. ..... 57/5

*Primary Examiner*—Donald Watkins
*Attorney, Agent, or Firm*—Donald H. Feldman

[57] ABSTRACT

A composite yarn comprising a component of staple fibres and a component formed by a continuous strand is spun on a friction spinning apparatus. Staple fibres are fed to a twisting zone where the fibres are twisted to form a staple strand with one end open. The continuous strand is joined with the staple strand at a position within a portion of the staple strand which is in the process of being twisted, and such that fibres are joined with the staple strand both upstream and downstream of the joining position and some fibres join with the staple strand on both sides of the joining position. In this way a yarn is formed with some fibres forming an inner core twisted with the continuous strand, with some fibres forming on outer sheath around the core and continuous strand and some fibres having part of their length in the core and part in the sheath.

10 Claims, 5 Drawing Figures

METHOD AND APPARATUS FOR FORMING COMPOSITE YARN

FIELD OF THE INVENTION

This invention relates to apparatus and method for forming a composite yarn comprising a component of staple fibres and a component formed by a continuous strand.

By continuous strand it is intended to include a continuous filament yarn, textured or flat, monofilament or multifilament, a spun staple yarn or a previously formed composite yarn.

BACKGROUND OF THE INVENTION

Many proposals have been made previously for forming composite yarns and these generally divide into a number of categories. In one category the composite yarn is proposed to be formed at very high speed by false twisting the continuous filament strand and attempting to attach the fibres to this strand as it passes. No success has yet been obtained with a process of this type.

In a second category a continuous strand, generally a continuous filament yarn is introduced into a staple fibre spinning system at some convenient point. This has been done with ring spinning systems with some success, but with the disadvantage of very low speeds. It has also been tried with various forms of open-end spinning systems, particularly rotor spinning, vortex spinning, electrostatic spinning and friction spinning. However little success has been obtained to date.

Specific proposals on the use of this technique in friction spinning have been disclosed in U.K. Pat. Nos. 1 518 771 (Fehrer), 2 001 359-A (Barmag) and 2 011 956-A (VUB). In all cases a continuous strand is fed axially of the yarn so that the staple fibres wrap around the outside of the core to form the composite yarn. This technique is unsatisfactory in that the wrapping staple fibres are insufficiently connected to the core and can be stripped relatively easily. U.K. Pat. No. 2 001 359-A proposes the use of colloidal silica to overcome this problem, which does not get to the heart of the problem that the structure of the yarn is unsatisfactory.

Proposals in relation to the rotor spinning technique are disclosed in U.K. Pat. Nos. 1 154 554 (VUB) and 1 495 713 (SSI) and U.S. Pat. No. 3 605 395 (Daiwa). In Daiwa and VUB the formed staple yarn is twisted around the continuous strand to form a composite yarn of corkscrew formation with the continuous filament unsatisfactorily on the surface. In SSI the core continuous filament is fed to the collecting groove of the rotor in a constant loop whereby it is absorbed into the centre of the staple strand and forms a yarn by the action of the untwisting false twist. This proposal has not achieved success presumably in view of the obvious technical difficulties and the unsatisfactory resultant yarn.

In relation to electrostatic and vortex open-end techniques, proposals have been made in U.S. Pat. Nos. 4 028 871 (Cor), 3 835 638 (U.S. Department of Agriculture, 2 817 947 (Strang) and in U.K. Pat. No. 1 373 255 (Goetzfried) in all of which the fibres are wrapped around an axial core of a continuous strand. Additionally Bobkowicz (various patents for example U.K. Pat. No. 1 569 110) has proposed bonding staple fibres to the outside of a continuous strand.

None of the above proposals utilizing open-end spinning techniques has been successful in that they do not form a satisfactory structure of a composite yarn. In all cases, either the continuous strand has formed the core around which the fibres are wrapped or alternatively the filament has been wrapped around a core of the fibres.

SUMMARY OF THE INVENTION

It is one object of this invention to provide a method of spinning a composite yarn which has a totally new structure superior to previous composite yarns.

The method comprises feeding fibres from the staple fibre component to form a staple fibre strand with one end open, twisting the strand adjacent the open end so that along a portion of its length the strand is in the process of being twisted to form a yarn and introducing the continuous strand into the staple fibre strand at a position which lies in the portion which is being twisted in such a manner that some of the fibres are joined with the strand on the downstream side of said position and some on the upstream side.

In this way some of the fibres form an inner core which is twisted with the continuous strand and some form an outer sheath.

In a particularly preferred arrangement some fibres are also joined with the strand at the position such that one part of their length lies in the inner core and one part in the outer sheath.

This method provides a yarn which is completely new in its structure and prevents or reduces the previous serious problem that the fibres can be readily stripped from the continuous strand during subsequent processing. Furthermore, depending upon the relative amounts of fibre in the core and sheath, the continuous strand can be subsequently fully covered by the sheath thus providing a yarn which is to outward view one totally of staple fibre.

The invention also is directed to an apparatus for carrying out the above defined method and to a yarn of the kind formed by the method.

DESCRIPTION OF THE PREFERRED EMBODIMENT

The apparatus is a modification of that described in copending U.S. application Ser. No. 324,465, filed Nov. 24, 1981 and the following is a general description of apparatus of that type.

Figure 1:
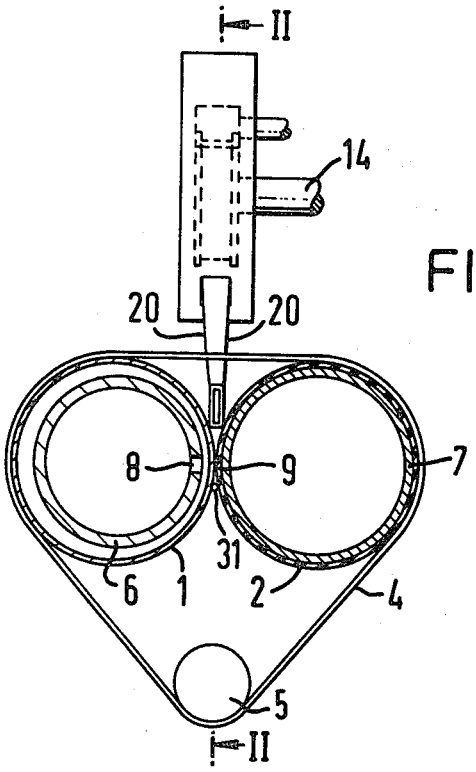
FIG. 1 is a schematic front view of an open and spinning apparatus according to the invention.
Figure 2:
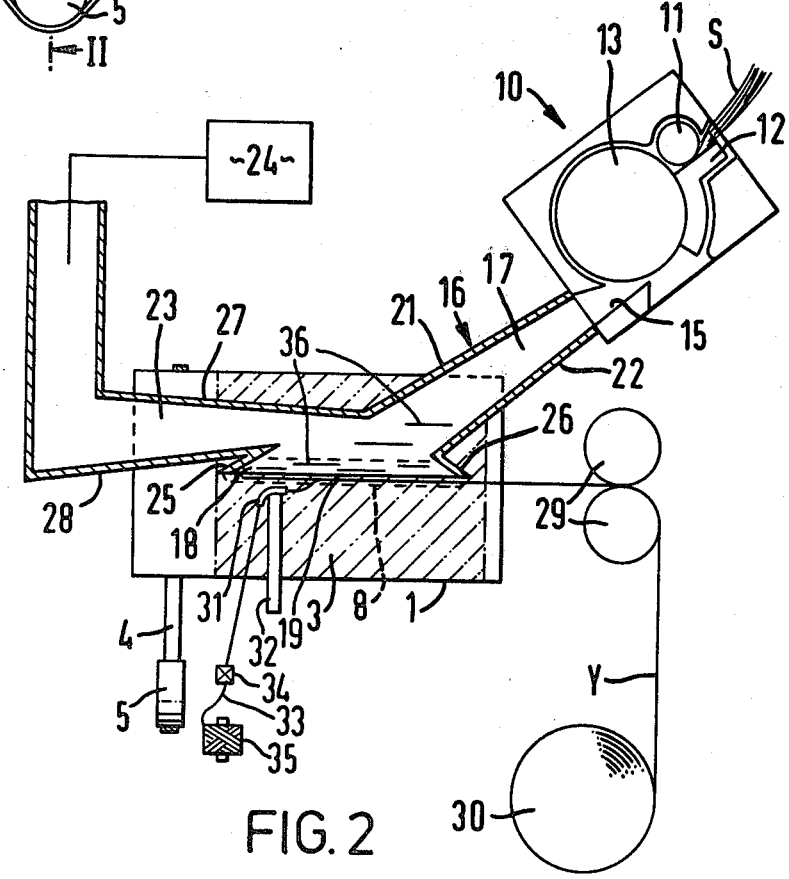
FIG. 2 is a schematic cross-sectional view of the apparatus shown in FIG. 1 taken on the line II—II.

Referring to FIGS. 1 and 2 the apparatus comprises a pair of parallel, closely spaced drums 1, 2. The surface of the drum 1 includes a portion which is perforated, as shown at the cross-hatched area 3 in FIG. 2, to define a yarn formation surface. The drums 1, 2 are mounted on bearings (not shown) for rotation in the same direction about their axes and driven by a belt 4 and a drive roller 5. The peripheral surface of the drums 1, 2 define between them a space which tapers to a narrow gap or throat at the region of closest approach.

Within the perforated portion 3 of the drum 1 is mounted a suction tube 6, which is connected to a source of suction (not shown). The tube 6 has a mouth in the form of a slot 8 to apply suction substantially along the full length of the perforated portion 3.

A fibre feed apparatus, generally indicated at 10, comprises a sliver feed roller 11, a feed pedal 12, a beater 13 mounted on a shaft 14 and a fibre feed passage 15. This type of fibre feed apparatus 10 is wellknown in open-end spinning systems of the spinning rotor type and an example is described in more detail in British Pat. No. 1,368, 886.

The fibres are conveyed from the fibre feed apparatus 10 substantially directly into the throat formed between the peripheral surfaces of the drums 1, 2 by a fibre feed duct 16. The fibre feed duct 16 has a first duct portion 17 having a fibre inlet aperture in communication with the passage 15, and a second terminal duct portion 18 which terminates in an extended mouth 19 within the throat. The first duct portion 17 is of varying rectangular cross-section defined by two side walls 20, which gradually converge as the first duct portion 17 approaches the throat, and by a front wall 21 and a rear wall 22, which gradually diverge as they approach the throat. The longitudinal axis of the first duct portion 17 is inclined at an angle of 25° with respect to the axis of the drums 1, 2. If desired, the front and rear walls 21, 22 can be made parallel.

At the junction of the first and second duct portions 17, 18 the front wall 21 terminates in an air channel or duct 23 which communicates with the terminal duct portion 18 for a purpose to be later described. The duct 23 extends from the terminal duct portion 18 in a direction generally parallel to the axes of the drums 1, 2 and is connected to a source of suction indicated schematically at 24. The terminal duct portion 18 widens in the vicinity of mouth 19 in that a front wall 25 thereof extends from the entrance of the suction duct 23 to a position corresponding to one end of the slot 8 and in that a rear wall 26 thereof is so angled as to extend to the other end of the slot 8. Thus the mouth 19 extends as a narrow slot along substantially the whole length of the slot 8 so as to maximise the area of the mouth in communication with the slot 8.

The duct 23 has upper and lower walls 27, 28, which diverge as the duct extends away from the interior of the fibre feed duct 16. The lower wall 28 extends slightly upwardly as it approaches and conjoins with the front wall 25 to form a baffle. This baffle is disposed below the upper wall 27 at a position displaced from the junction between the walls 21 and 27.

The throat forms a yarn formation zone in which the fibres are twisted by rotation of the drums 1, 2 into a yarn 'Y' which is drawn axially of the drums 1, 2 along the throat by a pair of delivery rollers 29, located on the opposite side of the fibre feed duct 16 to that of the suction duct 23, and wound into a package 30.

In operation, a sliver 'S' is forwarded between the nip formed between the feed roller 11 and the feed pedal 12 to an opening and combing action effected by needles or teeth on the peripheral surface of the beater 13. The opened fibres are conveyed on the peripheral surface of the beater 13 to the entrance of the fibre feed passage 15 where they are removed from the beater 13. In this passage 15 the fibres are entrained in an airstream derived from the source of suction connected to the tube 6. This source of suction communicates with the passage 15 through the slot 8, the perforated portions 3, the mouth 19 and the fibre feed duct 16. After passing through the passage 15 the fibres are conveyed by the airstream along the first duct portion 17 in which they lie generally in alignment with the direction of motion of the airstream i.e. at approximately 25° to the axes of the drums 1, 2 and in a direction opposite to the direction of yarn withdrawal.

At the termination of the first duct portion the fibres come under the influence of the suction derived through the suction duct 23. The influence of this suction causes the airstream and the entrained fibres to change their direction of motion, or at least the direction of those fibres in the vicinity of the outlet of the suction duct 23. These fibres, therefore, reach the throat, i.e. the yarn formation zone, with a direction of motion which approaches a direction which is more nearly parallel to the axes of the drums 1, 2. Thus these fibres are incorporated into the tail end of the spun yarn 'Y' as they lie in alignment, or substantially in alignment, with the axis of the yarn 'Y'. The baffle formed by the junction of the walls 25 and 28 serves to prevent the airflow in the duct 23 from directly countering the airflow through the mouth 19 and hence to avoid removal of fibres from the yarn formation zone by the suction airstream created in the suction duct 23. The suction duct 23 communicates with the fibre feed duct 16 through the front walls 21, 25 in the vicinity of the tail end of the yarn 'Y'. This ensures that the suction from the duct 23 will at least influence those fibres which will form the core section of the yarn so that they lie substantially parallel to the axis of the yarn as they are incorporated therein.

It is also important to ensure that the suction forces emanating from the suction duct 23 and the suction slot 8, act on the fibres in a balanced relationship. The suction force from the duct 23 should not, of course, be of sufficient strength to completely overcome the effect of the suction force acting on the fibres from the slot 8, otherwise useable fibres will be extracted through the duct 23, but should be of a magnitude just sufficient to cause a redirection of the fibres so that they lie substantially parallel to the axis of the yarn. The duct 23 is arranged adjacent to the mouth 19 and the throat so as to act upon the fibres as close to the mouth as possible without interfering with the airstream through the mouth and thus removing fibres. It is believed that the fibres in the feed duct have a tendency to turn from the feed direction of 25° toward the vertical direction as they come into the direct influence of the suction at the mouth. The creation of an additional airflow by the duct 23 across the mouth 19 opposes this tendency and acts to change the direction of the fibres so as to approach the wall 25 at an angle more nearly approaching a direction parallel to the yarn axis than they would otherwise do.

The drum 2 is formed of a metal core cylinder 7 on which is bonded a cylindrical shell 9 of a natural or synthetic rubber material.

The belt 4 is arranged to drive the drums 1 and 2 in clockwise direction as shown in FIG. 1, such that the surface of the roller 1 moves from the side adjacent the feed duct 16 into the throat and the roller 2 moves out of the throat toward the side adjacent the duct 16. It has been found that turning the drums in this direction enables a proper balance of the forces on the fibres within the throat and thus successful spinning conditions. Turning of the rollers in the opposite direction causes imbalance of the forces and spinning cannot properly be performed.

In accordance with a preferred embodiment of the present invention, the apparatus is modified to include a device for incorporating a continuous strand, generally a continous filament yarn, into the staple fibre strand as it is being formed.

The incorporating device comprises a tube 31 carried on a bracket 32. The tube 31 has a bore which is of the smallest diameter which will allow the continuous strand to pass through freely and is positioned as close to the rollers 1, 2, on the side remote from the feed duct 16, as is possible. To assist in depositing the continuous filament into the throat as close as possible to the throat and to the fibre strand, the side walls of the tube adjacent the rollers, as shown in FIG. 1, are chamfered. In one example the bore of the tube is of the order of 0.75 mm and the outside dimension of the tube about 1 mm.

The tube 31 is bent such that a continuous strand 33 withdrawn from a supply and tensioning device shown schematically at 34 and 35 is fed from a position remote from the rollers 1, 2, on the side opposite the feed duct 16.

The tube mouth terminates at a position intermediate the ends of the mouth of the feed duct 16. This position is adjustable but in one example which has been found to be fully satisfactory the mouth is 90 mm long and the end of the tube is arranged 25 mm from the end adjacent the baffle.

In operation, the fibre strand is formed in the throat substantially as described. Thus, the portion of the strand lying on the rollers is in the process of twisting to form a yarn, with formed twisted yarn drawn off through the rollers 29. In this way the continuous strand is introduced through the throat into the fibre strand in a joining position which lies in the twisting portion. The tail or open end of the strand is closely adjacent the end wall 25 and it has been found that fibres are fed over a range of about 60 mm from the end wall 25. Thus fibres, shown schematically at 36 are fed such that they join the strand on the downstream side of the joining position and on the upstream side. Additionally some fibres are fed such that they bridge the joining position and have some portion of their length lying on either side of the position.

Figure 3:
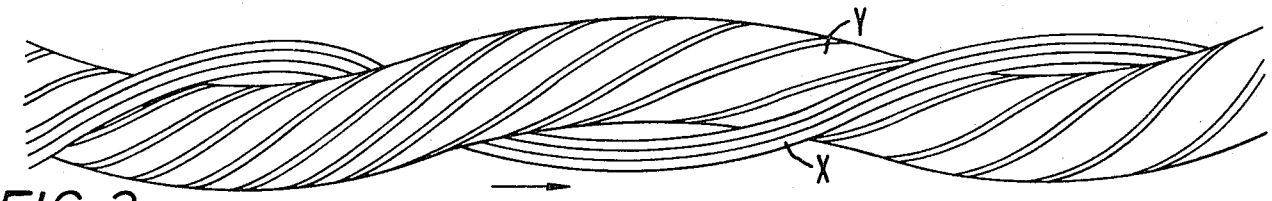
FIGS. 3, 4 and 5 show schematically different parts of the structure of yarn formed according to this invention such that the whole structure is a combination of the three figures.

Those fibres which join the staple strand upstream of the point where the continuous strand is added twist together to form a twisted tail or inner core. At the point, the twisted tail is rotating as it is twisting and moving forwards and thus the untwisted continuous strand is wrapped helically around the tail or inner core. Due to tension in the continuous strand, the combined strand downstream of the point takes on the appearance that the continuous strand and the tail are twisted around one another. This structure when formed is shown in FIG. 3, wherein X indicates the continuous strand which is untwisted and Y indicates the twisted staple strand.

Figure 4:
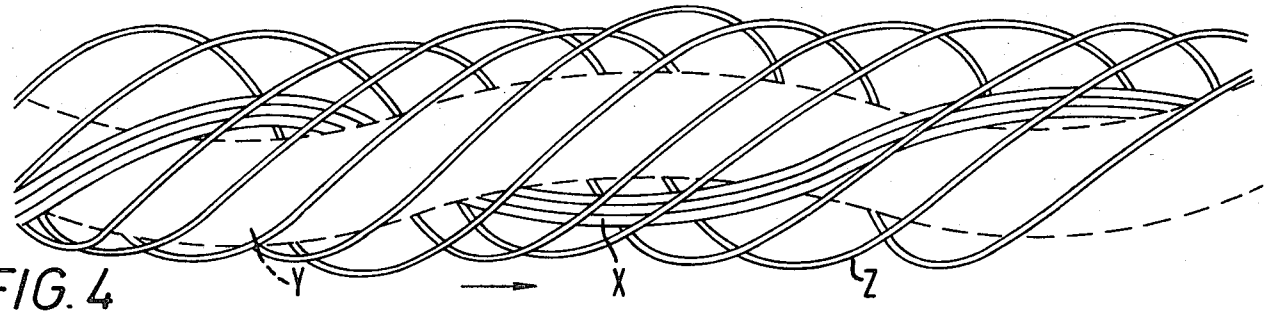

The additional fibres which join the strand downstream of the combining point twist around the outside of the combined strand to form a wrapping or sheath around the whole strand that is around the inner core and the continuous strand. The outside wrapping fibres are shown at Z in FIG. 4.

Figure 5:
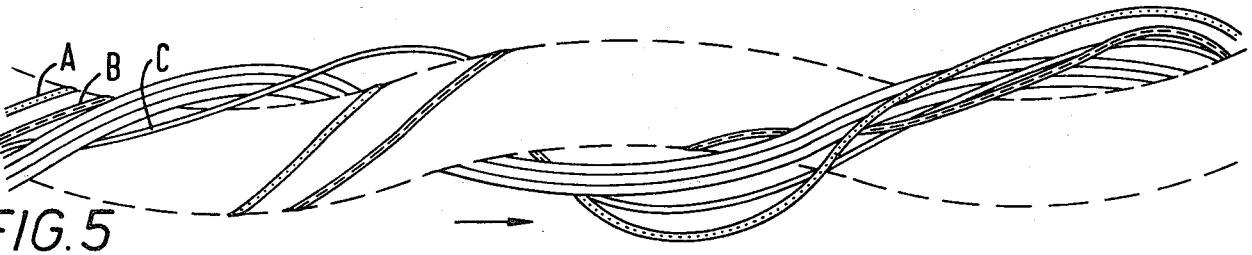

As explained previously, the fibres as they are fed lie in a direction substantially parallel to the strand. That is not to say that all the fibres are straight and parallel to the strand since fibres tend to take up random shapes and direction, but on average many of the fibres have at least a part of their length with the major component lying in the parallel direction. Thus many fibres are fed such that one end joins the fibre strand upstream of the combining point so that one part of the fibre forms the tail, which is twisted with the continuous strand, while the other end joins the strand downstream of the combining point so as to form a wrapper fibre. Three of these fibres are shown schematically at A, B and C in FIG. 5 and it can be seen that at the left hand end of the yarn the fibres wrap around and form part of the inner fibre structure Y of FIG. 3. At some point, dependent upon the position of the continuous strand X when the fibre joined, the fibres A, B and C emerge from inside the continuous strand and wrap around the outside with the fibres Z of FIG. 4. The complete structure of yarn thus comprises a combination of the structures shown in FIGS. 3, 4 and 5. The direction of movement of the yarn in formation is indicated by the arrow shown in FIGS. 3, 4 and 5.

It is possible to vary the position of the end of the tube 31 to obtain different amounts of fibre in the tail (FIG. 3) and in the wrapping part (FIG. 4) and this will give different properties. This will also vary the number of fibres which are wholly in the tail, wholly in the sheath and partly in both and it is possible to vary these amounts over wide limits and still obtain suitable yarn. It is also possible to vary the proportion of staple fibres to continuous strand within wide limits, and some examples of yarn which have been formed successfully are as follows:

(a)

Staple: 50% Polyester 50% Cotton
Filament: 22 Dtex 13 filament flat Nylon
Resultant yarn: 270 Dtex.

(b)

Staple: 50% Polyester 50% Cotton
Filament: 154/68 textured Nylon
Resultant yarn: 400 Dtex (c)

Staple: 100% Cotton
Filament: 154/68 textured Nylon
Resultant yarn: 600 Dtex (d)

Staple: 50% Polyester 50% Cotton
Filament: 167/34 Heat Set Polyester
Resultant Yarn: 400 Dtex (e)

Staple: 100% Cotton
Filament: 167/34 Heat set Polyester
Resultant yarn: 600 Dtex It has been found that yarn produced has very good resistance to stripping of the staple fibres because of the unique construction wherein some of the fibres are twisted with the continuous strand and some wrap around the outside. This is particularly so when some fibres are fed such that part of their length is included in the tail and part wraps around the outside.

We claim:

1. In a method of forming a yarn including a component of staple fibres and a component formed by a continuous strand, comprising feeding discrete fibres from the staple fibre component to form a staple fibre strand with one end open, twisting the strand adjacent the open end so that along a portion of its length the strand is in the process of twisting to form a yarn, withdrawing the twisted yarn, and combining the continuous strand with the staple fibre strand to form the yarn, the improvement wherein the continuous strand is introduced to the staple strand at a position intermediate the ends of the portion and the fibres are fed such that some fibres become joined with the strand on the downstream side of the position and some on the upstream side thereof.

2. A method according to claim 1, wherein at least some of the fibres are fed such that each is joined with the staple strand on the upstream side of the position and on the downstream side.

3. A method according to claim 2, wherein before joining the staple strand the continuous strand is guided up to a position closely adjacent the staple strand.

4. A method according to claim 3, wherein the continuous strand is guided so as to approach the staple strand in a direction substantially parallel thereto.

5. In an apparatus for forming a yarn including a component of staple fibres and a component formed by a continuous strand, comprising means for opening discrete fibres from a supply of the staple fibre component, means for feeding the discrete fibres to form a staple fibre strand with one end open, means for twisting the strand adjacent the open end so that along a portion of its length the strand is in the process of twisting to form a yarn, means for withdrawing the twisted yarn and means for introducing the continuous strand such that it combines with the staple fibre strand to form the yarn, the improvement wherein the means for introducing the continuous strand is arranged such that the strand is introduced to the staple fibre strand at a position intermediate the ends of the portion, and the fibre feed means is arranged such that some fibres are joined with the strand on the downstream side of the position and some on the upstream side thereof.

6. Apparatus according to claim 5, wherein the fibre feed means is arranged to feed at least some of the fibres to join the strand at the position.

7. Apparatus according to claim 6, wherein the fibre feed means is arranged to feed at least some of the fibres such that each is joined with the strand on the upstream side of the position and on the downstream side.

8. Apparatus according to claim 7, wherein it includes means for guiding the continuous strand to a position closely adjacent the fibre strand.

9. Apparatus according to claim 8, wherein the guide means is arranged to introduce the continuous strand with the fibre strand in a direction substantially parallel thereto.

10. Apparatus according to claim 8, wherein the guide means comprises a tube of small cross-section.

* * * * *